US006044760A

United States Patent [19]

Krüger

[11] Patent Number: 6,044,760

[45] Date of Patent: Apr. 4, 2000

[54] REVERSING DEVICE WITH A LINEAR DRIVE FOR A SHEET-FED ROTARY PRINTING PRESS

[75] Inventor: Michael Krüger, Edingen-Neckarhausen, Germany

[73] Assignee: Heidelberger Druckmaschinen AG, Heidelberg, Germany

[21] Appl. No.: 09/186,819

[22] Filed: Nov. 5, 1998

[30] Foreign Application Priority Data

Nov. 5, 1997 [DE] Germany ..... 197 48 870

[51] Int. Cl.[7] ..... B41F 13/24

[52] U.S. Cl. ..... 101/232; 271/291; 271/186

[58] Field of Search ..... 101/230, 231, 101/232; 271/225, 275, 291, 186

[56] References Cited

U.S. PATENT DOCUMENTS

| | | | |
|---|---|---|---|
| 4,669,715 | 6/1987 | Jeschke | 101/231 |
| 4,792,132 | 12/1988 | Jahme | 271/291 |
| 5,535,997 | 7/1996 | Croyle et al. | 271/291 |
| 5,732,623 | 3/1998 | Compera et al. | 101/232 |
| 5,950,540 | 9/1999 | Klein | 101/232 |
| 5,967,505 | 10/1999 | Lin et al. | 271/186 |

*Primary Examiner*—Eugene Eickholt
*Attorney, Agent, or Firm*—Herbert L. Lerner; Laurence A. Greenberg; Werner H. Stemer

[57] ABSTRACT

A reversing device for a sheet-fed rotary printing press, having a sheet transport device for accepting a sheet, that has been printed on one side thereof, at a leading edge thereof from an upline sheet-guiding cylinder, reversing the sheet by turning it about a longitudinal axis thereof in a sheet transport direction, and then transferring the sheet, in the reversed condition thereof with a leading edge thereof leading, to a downline sheet-guiding cylinder, and having a cam path extending substantially like that of a Möbius strip for guiding the sheet transport device, includes an electric linear drive for advancing the sheet transport device.

18 Claims, 5 Drawing Sheets

REVERSING DEVICE WITH A LINEAR DRIVE FOR A SHEET-FED ROTARY PRINTING PRESS

BACKGROUND OF THE INVENTION

Field of the Invention

The invention relates to a reversing or turning device for a sheet-fed rotary printing press, having a sheet transport device for accepting a sheet, that has been printed on one side thereof, at a leading edge thereof from an upline sheet-guiding cylinder, reversing the sheet by turning it about a longitudinal axis thereof in a sheet transport direction, and then transferring the sheet, in the reversed condition thereof with a leading edge thereof leading, to a downline sheet-guiding cylinder, and having a cam path extending substantially like that of a Möbius strip for guiding the sheet transport device.

Reversing devices for sheet-fed rotary printing presses have become known heretofore in the prior art and are used in recto/verso or first-form and perfector printing to reverse or turn over a sheet that has been printed on one side thereof, i.e., recto or first form, in upstream printing units so that it can be fed to one or more downline printing units for printing on the nonprinted side thereof. The reversing devices generally known heretofore from the prior art have a storage drum for this purpose, to which the sheets which have been printed on one side thereof are transferred from the impression cylinder of an upline printing unit and temporarily stored and are then taken over at a trailing edge thereof, counter to the direction of rotation of the storage drum, by a gripper device of a downline cylinder. The reversing devices in the prior art have a disadvantage in that the sheet is drawn off by the gripper devices of the downline sheet-guiding cylinder in a direction opposite to a natural direction of motion thereof from the storage drum. Particularly at high printing-press speeds, this change in the direction of motion of the sheet and the attendant change in impetus results in strong forces, which make it more difficult to feed the inverted sheet with maintained registration to the downstream printing units, and has a deleterious effect upon the print quality.

From the published German Patent Document DE-PS 34 44 848 C2 of the applicant of the instant application, a sheet reversing device for sheet-fed rotary printing presses has become known, moreover, wherein the sheet on being transported from an upline printing unit to a downline printing unit is reversed or inverted 180° about the longitudinal axis thereof. The reversal is performed thereat by a chain system with gripper devices secured thereto which extends, in a twisted manner, somewhat like a Möbius strip, between the printing units. Due to the chain system that is used, which is known also to be installed in delivery systems of sheet-fed rotary printing presses, reversal of the sheets while maintaining proper registration is achievable, particularly at high printing speeds, only at considerable technological effort and expense. The system, furthermore, is subject to the disadvantage that the spacing between two gripper bars is predetermined in advance and cannot be varied, the length of the system consequently having to be adapted exactly to the diameter relationships of the printing press.

SUMMARY OF THE INVENTION

It is accordingly an object of the invention to provide a reversing device for a sheet-fed rotary printing press which, even at high production-run speeds, assures a reliable, register-maintaining reversal of the sheets and, furthermore, assures the possibility of a precise and flexible correction of the position of the reversed sheet as it is fed to the downline printing unit.

With the foregoing and other objects in view, there is provided, in accordance with the invention, a reversing device for a sheet-fed rotary printing press, having a sheet transport device for accepting a sheet, that has been printed on one side thereof, at a leading edge thereof from an upline sheet-guiding cylinder, reversing the sheet by turning it about a longitudinal axis thereof in a sheet transport direction, and then transferring the sheet, in the reversed condition thereof with a leading edge thereof leading, to a downline sheet-guiding cylinder, and having a cam path extending substantially like that of a Möbius strip for guiding the sheet transport device, comprising an electric linear drive for advancing the sheet transport device.

In accordance with another feature of the invention, the sheet transport device includes feeder elements guidable along a rail system and carrying a gripper device for accepting the sheet.

In accordance with a further feature of the invention, the feeder elements are formed by at least two articulatedly connected individual elements formed of magnetizable material, and the reversing device includes drive stations disposed along the rail system for generating an electromagnetic migrating field for advancing the feeder elements.

In accordance with an added feature of the invention, the drive stations are disposed at such a distance from one another that at least one of the individual elements is always exposed to a direct effective range of the electromagnetic migrating field.

In accordance with an additional feature of the invention, the reversing device includes sensors disposed along the rail system for detecting motion of the feeder elements, advancement of the feeder elements being controllable and regulatable as a function of signals transmitted by the sensors.

In accordance with yet another feature of the invention, the reversing device includes a control unit assigned to the drive stations for controlling and regulating motion of the feeder elements along the rail system independently of one another.

In accordance with yet a further feature of the invention, the rail system is formed by a single rail running endlessly around, the single rail having two mutually associated rail sections extending along side lines of a Möbius strip, mutually associated pairs of the feeder elements of the sheet transport device being joined together by respective crossbars and being guidable in the rail sections.

In accordance with yet an added feature of the invention, the crossbars are articulatedly connected to respective pairs of the feeder elements.

In accordance with yet an additional feature of the invention, the crossbars are embodied as gripper devices with tongs-type grippers.

In accordance with an alternative feature of the invention, the rail system is formed by two separate single rails running endlessly around, the two rails being disposed relative to one another so that they extend along side lines of a doubly twisted Möbius strip, mutually associated pairs of the feeder elements of the sheet transport device being joined together by a crossbar and being guidable in the two separate rails running endlessly around.

In accordance with still another feature of the invention, the Möbius strip, along the side lines of which the two rails extend, has a first twist location along a transport path of the sheet transport device from the upline sheet-guiding cylinder to the downline sheet-guiding cylinder, and a second twist location along the transport path of the sheet transport device back from the downline sheet-guiding cylinder to the upline sheet-guiding cylinder.

In accordance with still a further feature of the invention, the reversing device includes an alternative rail system along which the sheet transport device is transferrable nonreversed, during recto printing by the printing press, from the upline sheet-guiding cylinder to the downline sheet-guiding cylinder.

In accordance with still an added feature of the invention, the alternative rail system for recto printing is coupled via electromagnetically actuatable shunts to the rail system for recto/verso printing.

In accordance with still an additional feature of the invention, the magnetizable material is formed by permanent magnets.

In accordance with an alternative feature of the invention, the magnetizable material contains permanent magnets.

In accordance with a concomitant feature of the invention, the reversing device includes a plurality of the sheet transport devices circulatable simultaneously with one another within the rail system.

The invention offers the advantage in particular that it can be adapted very flexibly to various types of printing presses with cylinders having diameters of different size, and that the number of sheet transport devices installed in the press, which is a decisive cost factor and definitively affects the operating speed of the sheet transport system, can be varied in a relatively simple manner without having to modify the fundamental structure of the reversing device. An advantage of the reversing device according to the invention is furthermore that the drive stations used to advance the sheet transport devices can be disposed at substantially freely selectable arbitrary locations along the rail system. As a result, even the most varied structural conditions can be taken into account in a flexible and economical manner in the development of a printing press or in retrofitting a printing press with a sheet reversing device.

Other features which are considered as characteristic for the invention are set forth in the appended claims.

Although the invention is illustrated and described herein as embodied in a reversing device with a linear drive for a sheet-fed rotary printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
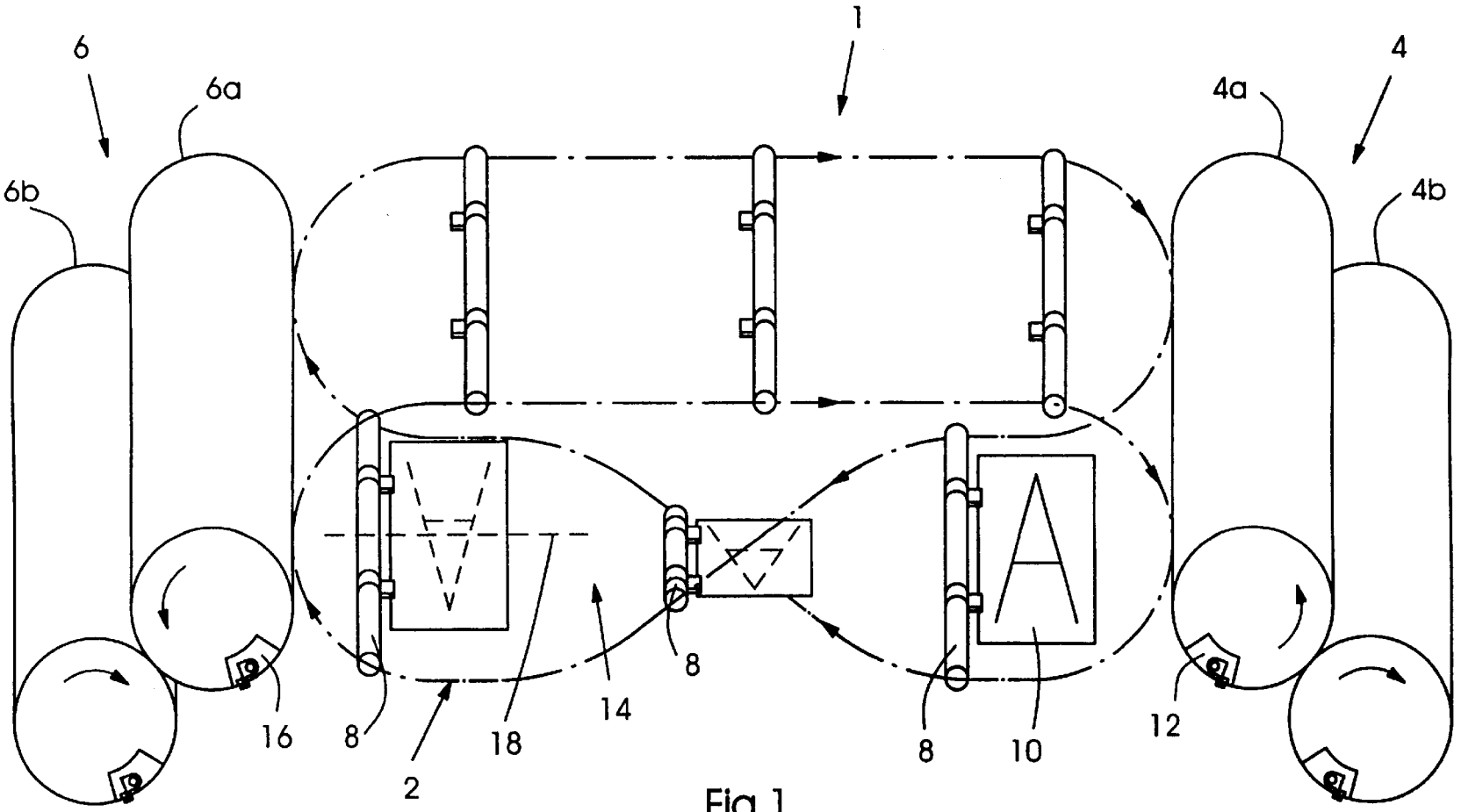
FIG. 1 is a diagrammatic and schematic perspective view of a first embodiment of a sheet reversing device according to the invention illustrating the course of a rail system thereof formed by an integral or one-piece rail extending all around.
Figure 2:
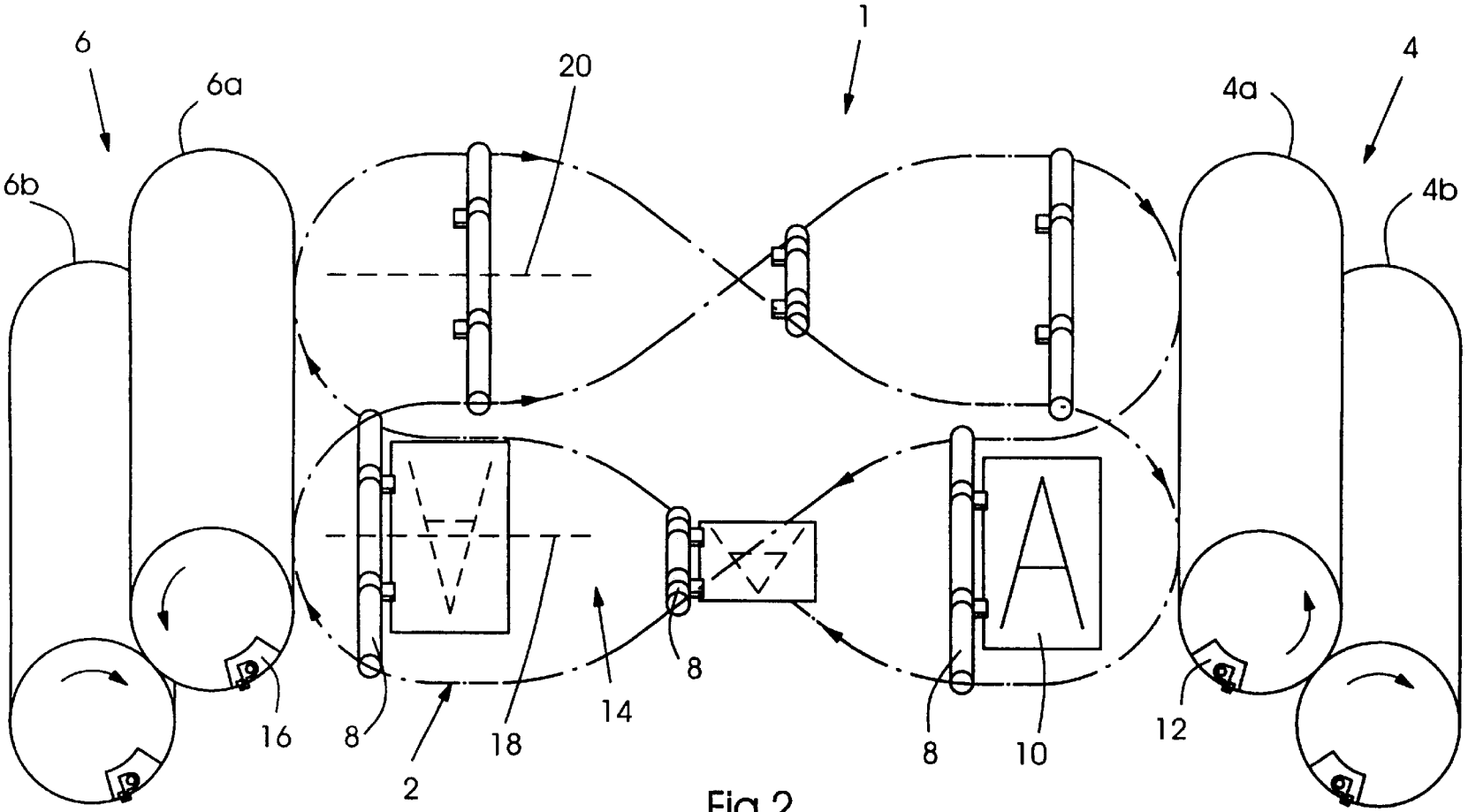
FIG. 2 is a view like that of FIG. 1 of a second embodiment of the sheet reversing device according to the invention, wherein the rail system is formed by two separately extending endless one-piece rails.
Figure 3:
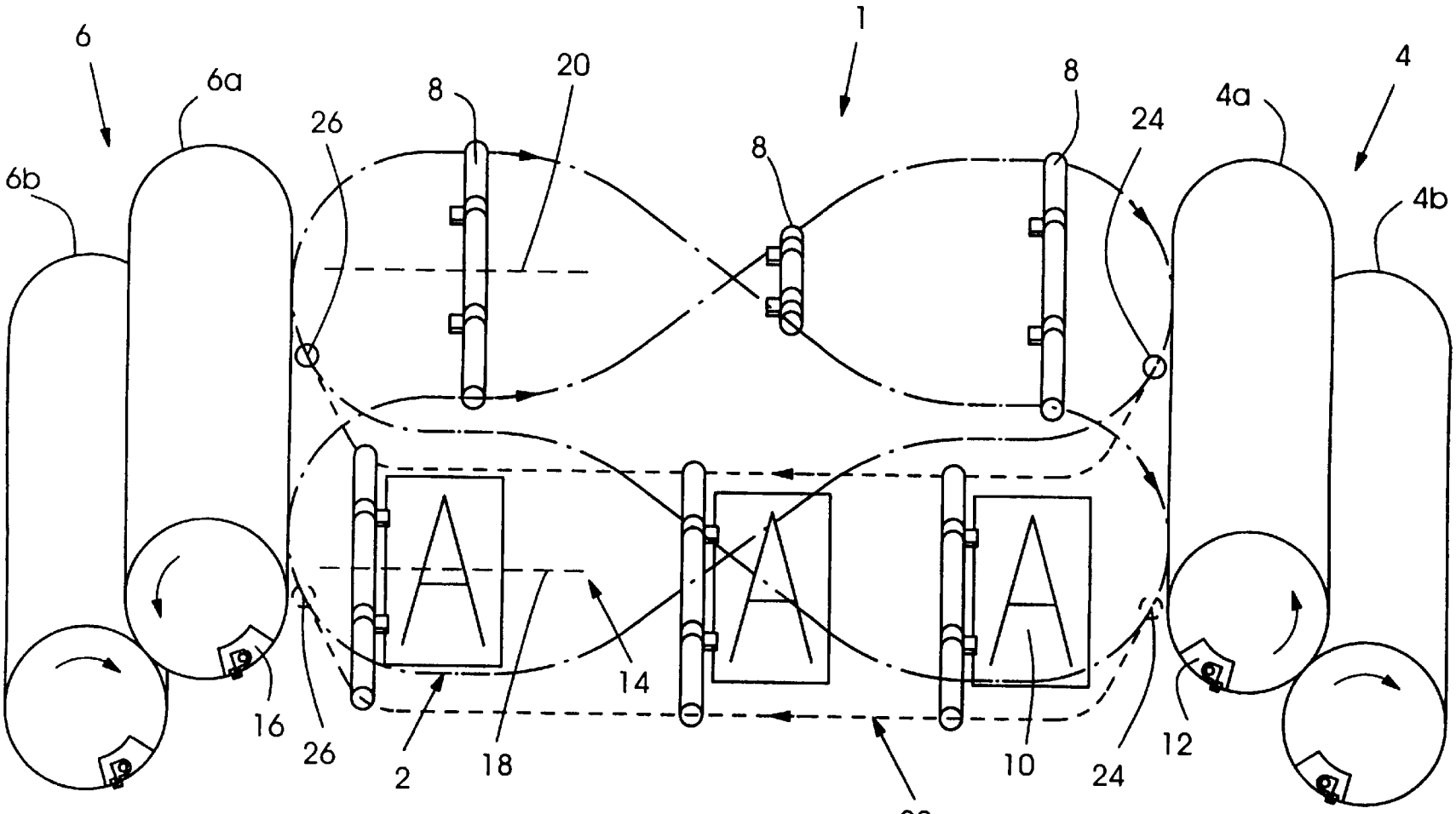
FIG. 3 is a view like that of FIG. 2 of a third embodiment of the invention wherein, in addition to the two rails of the FIG. 2 embodiment, a further alternative rail system is provided, by which the sheet, in recto, first-form or one-sided printing, can be fed nonreversed to a downline printing unit.

Referring now to the drawings and, first, particularly to FIG. 1 thereof, there is shown therein a sheet reversing device 1 according to the invention for a sheet-fed rotary printing press, which includes a rail system 2 disposed between an upline printing unit 4 and a downline printing unit 6. In FIGS. 1 to 3, in the interest of simplifying the drawing, the printing units 4 and 6 are represented merely by the respective upline impression cylinder 4*a* and transfer cylinder 4*b* and the downline impression cylinder 6*a* and transfer cylinder 6*b* thereof.

As shown in FIGS. 1 to 3, one or preferably more sheet transport devices 8, such as a plurality of eight or ten such devices, for example, are guided along the rail system 2; in the aforementioned figures of the drawings, they are diagrammatically represented as conventional gripper bars, which accept from a gripper device 12 of the upline impression cylinder 4*a* a sheet 10, that has been printed on one side thereof in the upline printing unit 4. The sheet transport devices 8 then transport the sheet 10, that is printed on one side thereof, along a path 14 prescribed by the rail system 2 to the downline impression cylinder 6*a*, wherefrom the sheet is taken over by a gripper device 16 of the downline impression cylinder 6*a* and fed to a printing nip, which is not otherwise illustrated in further detail, whereat the nonprinted side of the sheet 10 is printed. As is apparent from FIG. 1, the rail system 2 is twisted in the manner of a Möbius strip, and thus the sheet transport devices 8, guided by the ends thereof in the rail system 2, are reversed or inverted together with the transported sheet 10 about an axis 18 parallel to the sheet transport direction before the gripper device 16 of the downline impression cylinder 6*a* takes the reversed sheet 10 by the leading edge thereof from the sheet transport devices 8.

In a first embodiment of the sheet reversing device 1 according to the invention shown in FIG. 1, the sheet transport devices 8, after transferring the sheet 10 to the gripper device 16 of the downline impression cylinder 6*a*, preferably return substantially rectilinearly to the upline printing unit 4, whereat they take over a new sheet 10, which has been printed on one side thereof, from the gripper devices 12 of the upline impression cylinder 4*a* so as to transport it, reversed or inverted, to the downline printing unit 6. In the embodiment of the invention shown in FIG. 1, the rail system 2 is accordingly formed by an endless single or one-piece rail, along which the ends of the sheet transport devices 8 move.

In a second embodiment of the sheet reversing device 1 according to the invention shown in FIG. 2, by comparison, the rail system 2 is embodied as a doubly twisted Möbius strip wherein the sheet transport devices 8, after transferring the reversed sheet 10, which has been printed on one side thereof, to the gripper device 16 of the downline impression cylinder 6*a*, are reversed or turned over once again, through an angle of substantially 180°, about an axis 20 extending parallel to the direction of motion of the transport devices 8, so that when the latter take over the next sheet, which has been printed on one side, from the upline impression cylinder 4*a*, the sheet transport devices 8 again have been restored to the original orientation thereof.

As shown in FIG. 3, it is possible, in addition to the path 14 of the rail system 2 over which the sheets 10 are conveyed for the purpose of sheet reversal in recto/verso or first-form and perfector printing, to provide an additional alternative rail system 22, along which the sheets 10 are transported in purely first-form or one-sided printing without any reversal of the sheets 10 occurring. The alternative rail system 22 can be connected to the rail system 2, for example, via first, diagrammatically illustrated shunts 24 in the region of the upline impression cylinder 4*a* and via second, diagrammatically illustrated shunts 26 disposed in the region of the downline impression cylinder 6*a*. By simply switching the shunts 24, 26, the sheet transport devices 8, after taking over the sheets 10, which have been printed on one side thereof, from the gripper devices 12 of the upline impression cylinder 4*a*, are directed into the alternative rail system 22, which is preferably located below the rail system 2. The sheet transport devices 8 then move preferably rectilinearly along the alternative rail system 22 and, via the second shunts 26, return to the transfer region provided upline of the downline impression cylinder 6*a*, and in this region the leading edge of the sheets 10, which in this case have not been reversed, is taken over by the gripper devices 16 of the downline impression cylinder 6*a* and fed to a downline printing nip as described hereinabove.

Although the reversing device according to the invention has been described hereinabove in terms of an exemplary embodiment wherein the rail system is disposed between an upline impression cylinder 4*a* and a downline impression cylinder 6*a*, the fundamental principle of the invention is not limited thereto. For example, the rail system 2, 22 may also be disposed between an upline transfer cylinder and a downline transfer cylinder.

The actual construction of the rail system 2, 22 diagrammatically illustrated in FIGS. 1 to 3, together with the sheet transport devices 8 guided therein, is described hereinafter, in terms of a preferred embodiment shown in detail in FIGS. 4 and 5.

Figure 4:
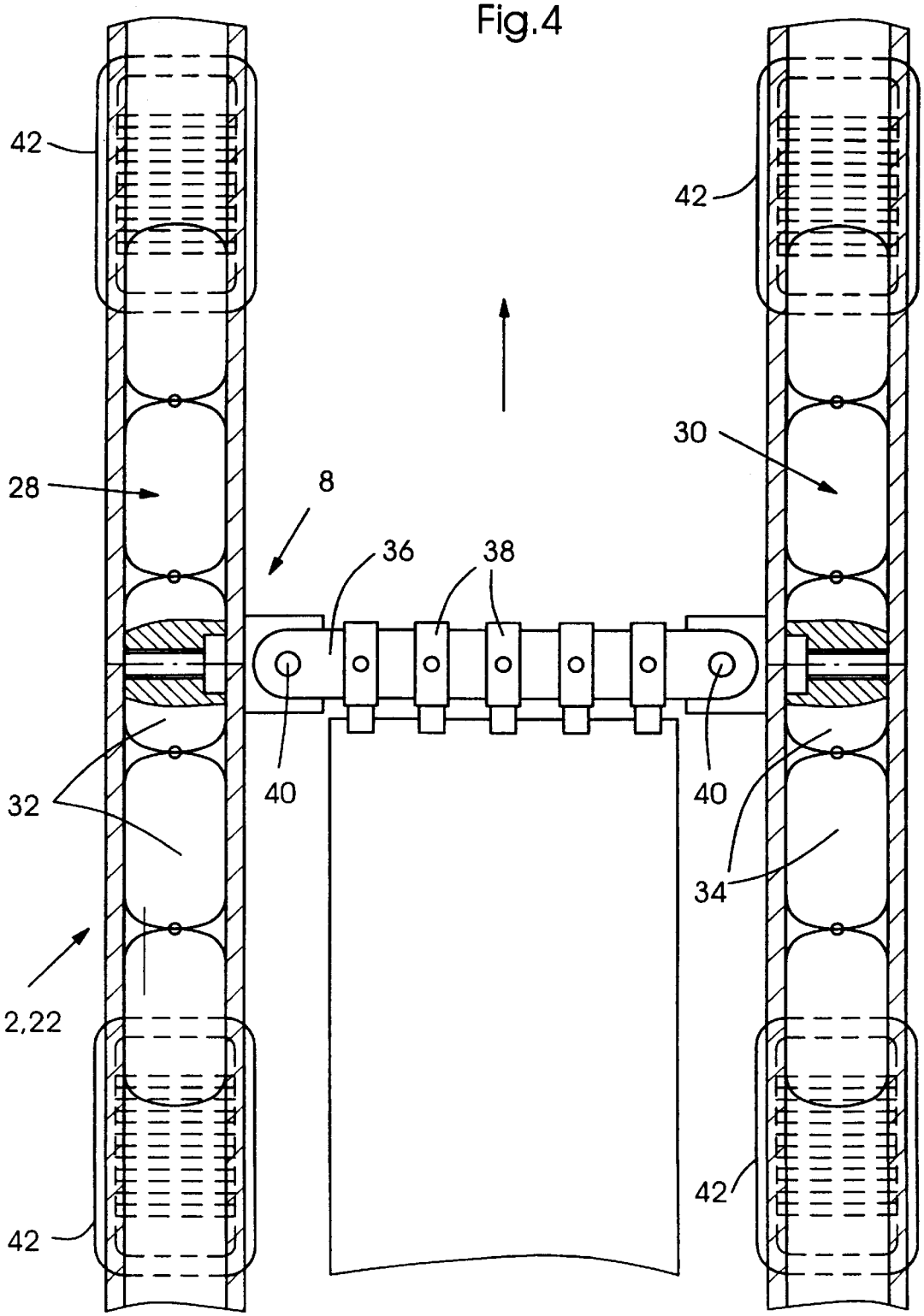
FIG. 4 is a fragmentary diagrammatic plan view of the rail system of the reversing device according to the invention.
Figure 5:
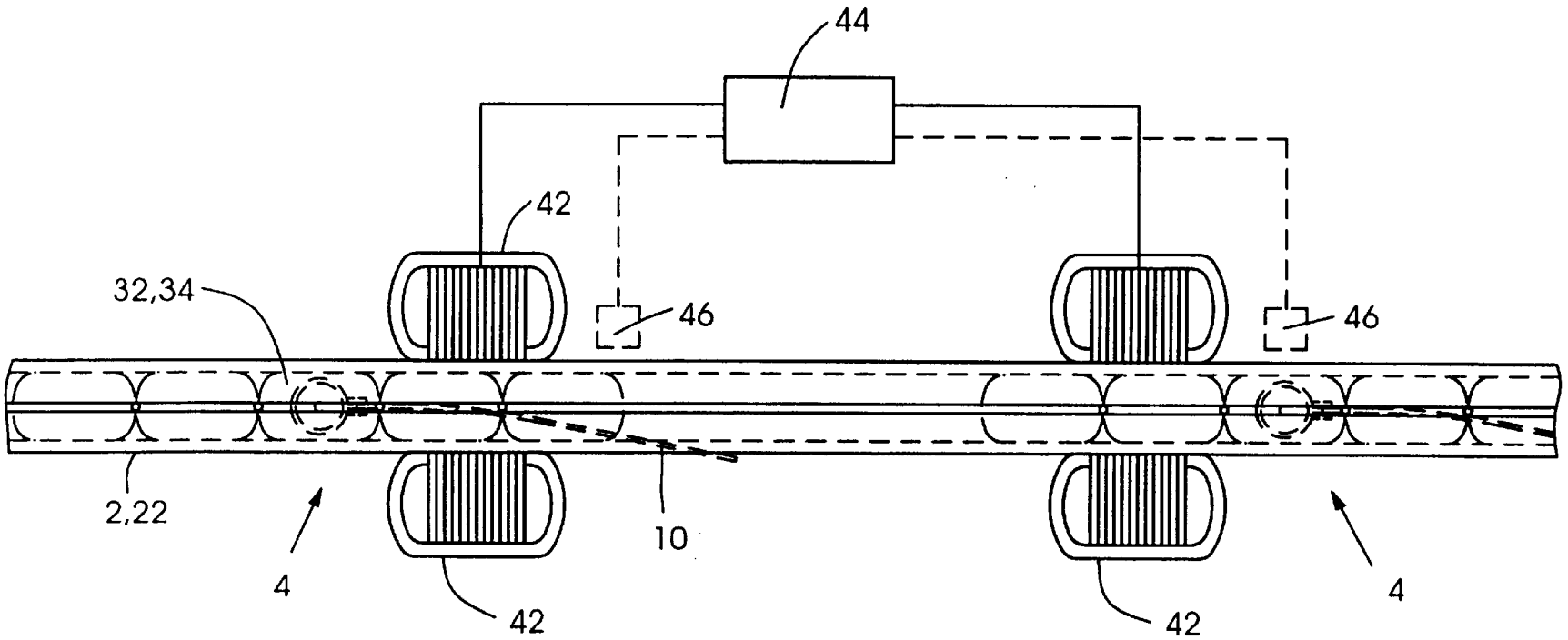
FIG. 5 is a reduced fragmentary, diagrammatic and schematic cross-sectional view of the rail system of FIG. 4.

As shown in FIGS. 4 and 5, the construction of the drive for the sheet transport devices 8 of the invention in the rail system 2 or 22 is based upon a conventional electric linear drive. In the embodiment of the invention shown in FIGS. 4 and 5, each of the sheet transport devices 8 includes a first and a second feeder element 28 and 30, which are guided substantially without play and parallel to one another in sections of the rail system 2, 22 facing one another. As shown in FIG. 4, the feeder elements 28 and 30 are preferably formed of two or more articulatedly or pivotally joined individual elements 32 and 34, which are formed of magnetizable material. The articulated connection of the individual elements is preferably punctiform, and may be formed, for example, by a tape, a cord, or a ball and socket joint or a knuckle joint, which allows motion of the individual elements 32 and 34 in the plane perpendicular to the direction of motion of the feeder elements 28 and 30. The magnetizable material may, for example, be a ferromagnetic material. In the same manner, provision may be made for the individual elements 32 and 34 of the first and second feeder elements 28 and 30 to be formed by or contain permanent magnets or, in the simplest case, armature turns.

As is apparent from FIG. 4, the first feeder element 28 and the second feeder element 20 of the sheet transport device 8 are joined together by a crossbar 36, which extends from an individual component element 32 of the first feeder element 28 to an individual component element 34 of the second feeder element 30, the crossbar 36 being preferably embodied directly as a conventional gripper bar with tongs-type grippers 38. In the preferred embodiment of the invention, the crossbar 36 is connected to the various individual component elements 32 and 34 of the first and second feeder elements 28 and 30, respectively, via articulating joints 40, so that, upon a motion of the feeder elements 28 and 30 along the side lines of the transport path 14 twisted somewhat like a Möbius strip, a corresponding three-dimensional mobility of the individual elements 32 and 34 relative to one another is assured. In the same manner, however, provision may be made for the crossbar 36 to be joined rigidly to the various individual component elements 32 and 34 of the first and second feeder elements 28 and 30.

As also shown in FIGS. 4 and 5, along the rail system 2, 22, drive stations 42 are provided which are in the form of electromagnetic coils generating an electromagnetic migrating field that interacts with the individual component elements 32 and 34 of magnetizable material and drives them. The drive stations 42 are not shown in FIGS. 1 and 3 in the interest of clarity in the drawing. In the preferred embodiment of the invention, each of the drive stations 42 can be triggered and regulated independently of one another by a control and regulating unit 44, as a result of which the advancement and position of the first and second feeder elements 28 and 30 and thus of the sheet transport devices 8 within the rail system 2, 22 can be controlled or regulated independently of one another.

As illustrated in FIG. 5, in the preferred embodiment of the invention, additional sensors 46 are disposed along the rail system 2, 22 for detecting the position and/or speed of the first and second feeder elements 28 and 30 in the rail system 2, 22 and for feeding them to the control and regulating unit 44 in the form of corresponding control and regulation signals, this unit 44, in accordance with these control and regulation signals of the sensors 46 undertaking a correction of position and/or speed of the first and second feeder elements 28 and 30 in the rail system 2, 22. As a result thereof, it becomes possible to form both the spacings between the sheet transport devices 8 differently as a function of the respective position in the rail system 2 and also to perform a skewed-register correction of the sheets 10 upon transfer thereof to the downline gripper device 16.

As shown in the same manner in FIG. 5, the drive stations 42 are disposed in pairs preferably above and below each rail, when considered in terms of a horizontally extending section of the rail system 2, 22, the spacing between two successive drive stations 42 being preferably less than the length of the first and second feeder elements 28 and 30. Assurance is thereby provided that at least one of the individual component elements 32 and 34 of magnetizable material is always exposed to the immediate effective range of the electromagnetic migrating field that effects the advancement of the feeder elements 28 and 30.

Although the sheet reversing device 1 of the invention has been described as having a linear drive, for example, wherein the feeder elements 28 and 30 are "snakelike" feeder elements with a plurality of individual component members 32 and 34 of magnetizable material joined together in an articulated manner, the fundamental principle thereof is not limited to the embodiment of an electric linear drive such as is described hereinabove. In the same manner, provision may be made for the feeder elements 28 and 30 to have only one individual component member of magnetizable material, and for the drive stations 42 to be formed by a single coil, extending along the rail system 2, 22 and having preferably individually triggerable windings.

The possibility also exists of embodying the feeder elements as coils which are supplied from a current supply extending in the rail system 2, 22 and triggerable individually. In this regard, coils, or magnets, for example, may be disposed along the rail system 2, 22.

Moreover, it is conceivable for the sheet transport device 8 of the invention to include only a single feeder element, to which the crossbar 36 is joined in a floating manner. As a result, particularly in the case of the embodiment of the invention shown in FIG. 2, wherein the rail system 2 extends along the side lines of a doubly twisted or coiled Möbius strip, one of the two single rails of the rail system of the embodiment of the invention shown in FIG. 2 can be dispensed with.

I claim:

1. A reversing device for a sheet-fed rotary printing press, having a sheet transport device for accepting a sheet, that has been printed on one side thereof, at a leading edge thereof from an upline sheet-guiding cylinder, reversing the sheet by turning it about a longitudinal axis thereof in a sheet transport direction, and then transferring the sheet, in the reversed condition thereof with a leading edge thereof leading, to a downline sheet-guiding cylinder, and having a cam path extending substantially like that of a Möbius strip for guiding the sheet transport device, comprising an electric linear drive for advancing the sheet transport device.

2. The reversing device according to claim 1, wherein the sheet transport device includes feeder elements guidable along a rail system and carrying a gripper device for accepting the sheet.

3. The reversing device according to claim 2, wherein said feeder elements are formed by at least two articulatedly connected individual elements formed of magnetizable material, and including drive stations disposed along said rail system for generating an electromagnetic migrating field for advancing said feeder elements.

4. The reversing device according to claim 3, wherein said drive stations are disposed at such a distance from one another that at least one of said individual elements is always exposed to a direct effective range of said electromagnetic migrating field.

5. The reversing device according to claim 3, including sensors disposed along said rail system for detecting motion of said feeder elements, advancement of said feeder elements being controllable and regulatable as a function of signals transmitted by said sensors.

6. The reversing device according to claim 3, including a control unit assigned to said drive stations for controlling and regulating motion of said feeder elements along said rail system independently of one another.

7. The reversing device according to claim 2, wherein said rail system is formed by a single rail running endlessly around, said single rail having two mutually associated rail sections extending along side lines of a Möbius strip, mutually associated pairs of said feeder elements of the sheet transport device being joined together by respective crossbars and being guidable in said rail sections.

8. The reversing device according to claim 7, wherein said crossbars are articulatedly connected to said respective pairs of said feeder elements.

9. The reversing device according to claim 8, wherein said crossbars are embodied as gripper devices with tongs-type grippers.

10. The reversing device according to claim 2, wherein said rail system is formed by two separate single rails running endlessly around, said two rails being disposed relative to one another so that they extend along side lines of a doubly twisted Möbius strip, mutually associated pairs of said feeder elements of the sheet transport device being joined together by a crossbar and being guidable in said two separate rails running endlessly around.

11. The reversing device according to claim 9, wherein said crossbars are articulatedly connected to said respective pairs of said feeder elements.

12. The reversing device according to claim 11, wherein said crossbars are embodied as gripper devices with tongs-type grippers.

13. The reversing device according to claim 10, wherein said Möbius strip, along said side lines of which said two rails extend, has a first twist location along a transport path of the sheet transport device from the upline sheet-guiding cylinder to the downline sheet-guiding cylinder, and a second twist location along said transport path of the sheet transport device back from the downline sheet-guiding cylinder to the upline sheet-guiding cylinder.

14. The reversing device according to claim 2, including an alternative rail system along which the sheet transport device is transferrable nonreversed, during recto printing by the printing press, from the upline sheet-guiding cylinder to the downline sheet-guiding cylinder.

15. The reversing device according to claim 14, wherein said alternative rail system for recto printing is coupled via electromagnetically actuatable shunts to the rail system for recto/verso printing.

16. The reversing device according to claim 2, wherein said magnetizable material is formed by permanent magnets.

17. The reversing device according to claim 2, wherein said magnetizable material contains permanent magnets.

18. The reversing device according to claim 7, including a plurality of the sheet transport devices circulatable simultaneously with one another within said rail system.

* * * * *